United States Patent [19]

Bokor

[11] Patent Number: 5,056,286

[45] Date of Patent: Oct. 15, 1991

[54] SCREEN PLATE

[75] Inventor: Anton Bokor, Stutensee-Blankenloch, Fed. Rep. of Germany

[73] Assignee: Ludwig Krieger Draht-und Konststoff, Karlsruhe, Fed. Rep. of Germany

[21] Appl. No.: 414,319

[22] Filed: Sep. 29, 1989

[30] Foreign Application Priority Data

Oct. 8, 1988 [DE] Fed. Rep. of Germany ... 8812647[U]

[51] Int. Cl.[5] ..... E06B 3/54

[52] U.S. Cl. ..... 52/483; 52/506; 52/507

[58] Field of Search ..... 52/663, 507, 508, 510, 52/480, 778, 779, 780, 506, 511, 483

[56] References Cited

U.S. PATENT DOCUMENTS

| | | | |
|---|---|---|---|
| 3,367,078 | 2/1968 | Thompson, Jr. | 52/507 |
| 3,946,529 | 3/1976 | Chevaux | 52/506 X |
| 4,094,108 | 6/1978 | Scott | 52/480 X |
| 4,730,424 | 3/1988 | Green et al. | 52/507 X |

*Primary Examiner*—David A. Scherbel
*Assistant Examiner*—Creighton Smith
*Attorney, Agent, or Firm*—Antonelli, Terry, Stout & Kraus

[57] ABSTRACT

Screen plates comprise a support frame with support profiles and screen linings made from a rubber elastic material arranged in field-like and detachable manner thereon and are fixed between adjacent support profiles by means of ledges located on their opposite end faces and projecting downwards over their underside. A particularly simple construction from the fitting and replacement standpoint with respect to the individual screen linings and in particular for the purpose of preventing wear, is obtained if the support profiles are constructed as I-profiles and the ledges of the screen linings are provided on their remote outsides with, in each case, one slot engaging over the beams of adjacent I-profiles from the free edge, the width of each screen lining measured on the slot bottom being at least zonely somewhat larger than the clear width between the beams of adjacent I-profiles.

11 Claims, 1 Drawing Sheet

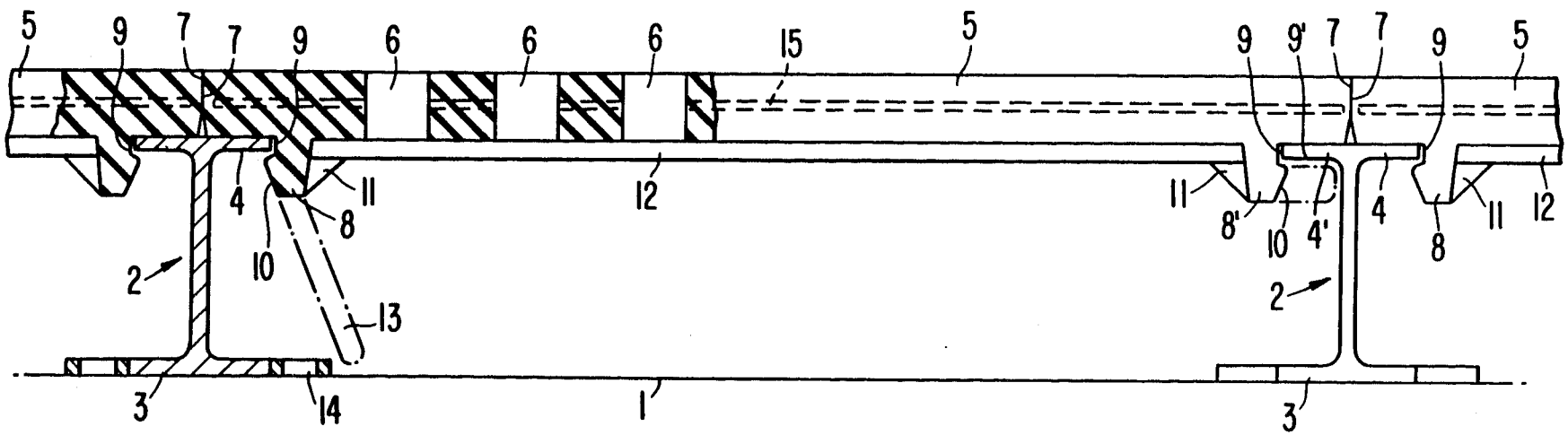
5
9
7
7
9'
9
5
15
6
6
6
9
7
7
9
5
12
11
8
4
4'
10
8'
11
12
11
8
10
4
2
2
1
3
3
13
14

SCREEN PLATE

BACKGROUND OF THE INVENTION

The invention relates to a screen plate, comprising a support frame with support profiles and screen linings made from a rubber elastic material arranged in field-like and detachable manner thereon and which are fixed in locking manner between adjacent support profiles by ledges arranged on their facing end faces and projecting downwards over their underside.

Screen plates or sieve bottoms of the aforementioned construction are e.g. used in the working up of mineral building materials and in particular in the classification of mineral bulk materials. They comprise a substructure in the form of a support frame, which is vibrated by an unbalance drive, as well as several screen fields, which are interchangeably fitted to the substructure and which can be individually replaced in the case of wear.

The main problem in connection with such screen plates is the fixing of the screen linings to the substructure, because the fastening must on the one hand absorb the high dynamic loads and the deformation forces resulting from these and also the applied loads, but must on the other hand ensure a simple and rapid fitting and removal of individual screen linings. For this purpose special support profiles are provided on the substructure and receive the screen linings.

In the known screen plates, the support profiles have through holes, slots or upwardly open cavities, e.g. in the manner of a U-profile with drawn in legs. Adjacent screen linings are provided on their end faces with reciprocally supplementing pins or ledges, which are in each case driven from above into a through hole or cavity and are locked by suitable undercuts. The end faces of the screen linings and the pins or ledges are located in one plane (DE-C 36 06 854). Instead of this, it is also known (DE-A 27 06 277) to interconnect the screen linings by tooth-like construction of their end faces and to lock same to a solid support profile by mutually supplementing recesses on the underside. In another known construction (DE-C 26 22 709, DE-A 26 32 511, 27 49 489) between adjacent screen linings are additionally driven bolts, clamping ledges, etc., which brace the ledges or pins on the screen linings within the slots, through holes or cavities on the support profiles. In all the known constructions either special support profiles are required, or additional fixing means (bolts, clamping ledges) are needed. Considerable difficulties and a large amount of force is required for fitting and removing the screen linings and it is unavoidable that on lifting out one screen lining, the adjacent screen lining will also be loosened.

The aim underlying the invention essentially resides in providing a screen plate, which only requires the simplest standard profiles for the substructure and permits an easy fitting and removal of the screen linings.

In the case of the aforementioned screen plate, the invention is characterized in that the support profiles are constructed as I-profiles and that the ledges of the screen linings have on their facing outsides in each case a slot engaging or gripping over the beam of adjacent I-profiles from the free edge thereof, the width of each screen lining measured on the slot bottom being at least zonely somewhat larger than a clear width between the beams of adjacent I-profiles.

The invention gives the advantage that inexpensive series-produced profiles in the form of I-profiles can be used and are fixed to the substructure. The I-profile beams are used for anchoring the screen linings, in that in each case one screen lining with its frontal ledges is inserted between the I-profiles and the ledges spring inwards due to their rubber elasticity and lock with their slot over the I-beams, so that the screen lining is horizontally and vertically fixed. As a result of the at least zonely larger width of the screen linings in the slot bottom, the screen linings are secured between the I-profiles and, as a function of the oversize quantity, are also pretensioned or prestressed. The removal, like the fitting of the individual screen linings can easily take place by levering out or driving in, which ensures that always only the desired screen lining is detached or, on fitting, each screen lining can be individually fixed.

It is admittedly known in the case of hard metal screens, to fix the screen linings with brackets located on the bottom to the beams of the T-profiles, but the screen linings must then be successively engaged from the side (DE-C 2 417 483).

According to a preferred embodiment of the invention, the ledges are inwardly and downwardly displaced with respect to the end faces of the screen lining and the adjacent screen linings resting on the top of the beams of the I-profiles are in contact with the end faces and terminate flush with one another.

As a result of the above construction, the advantage is obtained that all the fastening means are located below the actual screen surface and consequently little screen surface is lost for this purpose. It is also advantageous for the support profiles are completely covered with respect to the screen feed and are consequently subject to no wear and also a through screen surface is obtained, so that the screen feed can migrate from the feed to the discharge end without obstacles (gaps or the like) in the vicinity of the joints of the screen linings and also no screen feed can penetrate between said linings.

According to another embodiment, the width of the screen linings measured on the slot bottom is over the entire length somewhat greater than the clear width between the beams of adjacent I-profiles, so that there is a firm fixing or pretensioning over the entire width. This can optionally be further increased in that the facing end faces of the screen linings are snugly fitted above the I-profile beams and optionally under a slight pretensioning of the individual screen linings.

An advantageous embodiment is characterized in that the ledges on their back surface remote from the slot are supported via spaced, integral angle brackets on the underside of the screen lining.

The angle brackets ensure that the resiliency of the ledges is reduced or eliminated at certain points of the screen lining, so that the ledge is securely locked to the beam of the I-profiles over the entire length. These angle brackets also ensure a punctiform supporting or pretensioning.

The same function, as well as the stiffening of the screen linings in their plane is served by the measure that, at right angles to the ledges, the screen lining has through reinforcing ribs and that the angle brackets are located in the vicinity thereof.

As a result of the aforementioned construction, the individual screen lining is additionally stiffened and under load a curving up or through is prevented. This can be further assisted in that the screen lining is provided with a reinforcement passing between the end faces and optionally the screen lining can additionally be provided with a steel reinforcement positioned in the reinforcing ribs.

The further measure that the ledges are provided on their outside with insertion bevels facing the I-profiles further simplifies the fitting of the screen lining.

A preferred embodiment of the invention is characterized in that in each case one ledge of each screen lining has a deeper slot than the other ledge and by the deeper slot the screen lining can be laterally mounted on the beam, while the other ledge can be mounted from above on other I-profile. The slot on the one ledge of the screen lining can have a depth substantially corresponding to the width of the I-profile beam over which it engages.

In this embodiment, the screen lining with the deeper slot is engaged on one support profile and is only resiliently locked on to the other support profile with the facing ledge or its slot. This considerably facilitates fitting, because the screen lining is fixed on one side and only has to be driven in on the other side. Conversely, on disassembly, the advantage is obtained that the screen lining only has to be lifted out on one side, whereas it remains fixed on the other side and is subsequently laterally drawn off. This is particularly advantageous if there are fittings, such as spraying devices and the like above the screen surface.

According to a further advantageous development, the ledges are drawn down close to the support frame while laterally covering the support profile. This construction leads to the major advantage that the support profile, including its fastening to the support frame, is protected against the screen feed passing through the screen lining and its abrading action, so that the life becomes substantially unlimited.

BRIEF DESCRIPTION OF THE DRAWING

The Single FIGURE of the drawing is a partial cross-sectional longitudinal view of a screen plate constructed in accordance with the present invention.

DETAILED DESCRIPTION

The screen plate comprises a support frame 1 forming the substructure and reciprocally spaced I-profiles 2, which are fixed by their lower flange 3 to the support frame 1. The upper flange 4 or the upper beam of the I-profile serves to receive the screen linings 5 made from rubber elastic material and for forming the screen plate several of these are arranged in succeeding manner and optionally also in juxtaposed manner. The screen linings 5 between adjacent I-profiles 2 in each case form a screen field and in each case have screen apertures 6 with the same cross-section.

Parallel to its facing end faces 7, each screen lining 5 has downwardly projecting ledges 8, which are nose-like in cross-section and have on their outside a slot 9. Ledges 8 are positioned spaced from the end face 7 of the screen lining, so that successively arranged screen linings can abut against one another with their end faces 7 and can terminate flush at the top. By means of slot 9 the screen linings 5 are fixed by pressure from above on the I-profiles, in that on inserting the individual screen lining between adjacent I-profiles, the ledges resiliently give way and finally lock with the slot 9 over the outer edge of the I-profile beam. To facilitate insertion, insertion bevels 10 are externally provided on the ledges 8. In the fitted state the screen linings are slightly pretensioned between the I-profiles due to a corresponding dimensioning of the width thereof on the slot bottom with respect to the clear width between the beams of adjacent I-profile beams 2.

At certain, spaced points, the ledges 8 are supported by integral angle brackets 11 on the underside of the screen lining, so as in particular in the case of a considerable length of the ledges to prevent excessive springing out of the latter and in punctiform manner maintain the pretensioning. This function, as well as the additional stiffening of the individual screen lining is also fulfilled by reinforcing ribs 12 shaped on to the underside and which extend between the individual ledges and preferably pass over the angle brackets 11. The screen linings can additionally be provided with a steel reinforcement 15, which can optionally be used for pretensioning (curving upwards) the screen linings 5.

As is shown in dot-dash manner with respect to the left-hand ledge in the drawing, ledge 8 can have an extension 13, which extends up to the support frame 1 and covers the complete support profile 2 with respect to the screen feed passing through the screen aperture 6 and consequently protects same against wear. This measure also protects the fastening of the support profile 2, which takes place by screws passing through the bores 14 on the lower flange.

In a modified construction shown in dot-dash manner to the right in the drawing, one of the two slots, namely slot 9', has a much greater depth, so that the ledge 8' completely engages over one side 4' of beam 4 of I-profile 2. During assembly, the screen lining 5 with slot 9' on ledge 8' is initially mounted on part 4' of beam 4 and is subsequently locked on to the facing side through the springing back of ledge 8. Conversely, during disassembly, the screen lining 5 is lifted out in the vicinity of ledge 8 and is then drawn from the facing I-profile.

I claim:

1. Screen plate comprising a support frame, a plurality of spaced support profiles disposed on said support frame, a plurality of multi-apertured screen linings of a rubber elastic material respectively arranged between adjacent support profiles, ledge means arranged along respective opposite end faces of the respective screen linings projecting downwardly from an underside of said screen lining for detachably mounting the respective screen linings between adjacent support profiles, wherein each of the support profiles are constructed as I-shaped beams each having a central web and an upper flange and lower flange arranged at respective opposite ends of the central web, and each of the ledge means includes a slot means opening in a direction of the respective end faces for engaging a free edge of the upper flange of adjacent I-shaped beams with a portion of the respective screen linings disposed over an upper surface of the upper flanges of the respective adjacent I-shaped beams, and wherein a width of each of the screen linings measured on a bottom of the slot means is at least zonally somewhat larger than a clearance width between the free edges of the upper flanges of adjacent I-shaped beams whereby the screen linings are pretensioned between adjacent I-shaped beams.

2. Screen plate according to claim 1, wherein the ledge means are inwardly and downwardly displaced with respect to the respective end faces, and wherein the adjacent screen linings resting on the upper surface of the upper flanges of the I-shaped beams contact one another and terminate with end faces of the adjacent screen linings being flush with one another.

3. Screen plate according to one of claims 1 or 2, wherein the width of the screen linings measured on the bottom of the slot means is somewhat greater over an entire length than the clearance width between the free edges of the upper flanges of adjacent I-shaped beams.

4. Screen plate according to one of claims 1 or 2, wherein spaced integrally formed angle bracket means are provided on the ledge means on a back surface thereof remote from the slot means for supporting the underside of the screen linings.

5. Screen plate according to claim 4, wherein reinforcing rib means are provided on the underside of the respective screen linings and extend at right angles to the ledge means, and wherein the angle means are arranged in an area of the reinforcing rib means.

6. Screen plate according to claim 5, wherein reinforcement means are provided in the respective screen linings extending between the respective end faces.

7. Screen plate according to claim 5, wherein the reinforcement means includes a steel reinforcement arranged in the reinforcing rib means.

8. Screen plate according to claim 7, wherein insertion bevel means are provided along an outer portion of respective ledge means for facilitating engagement of the slot means with the free edges of the upper flanges of adjacent I-shaped beams.

9. Screen plate according to one of claims 1 or 2, wherein one ledge means arranged along one of the end faces of each screen lining has a slot means with a depth deeper than the slot means in the ledge means arranged along the other end face whereby said slot means having the deeper depth is adapted to be laterally mounted on while the other ledge means may be locked on the upper flange of the adjacent I-shaped beam.

10. Screen plate according to claim 9, wherein the depth of the slot means having the deeper depth substantially corresponds to a width of the upper flange of the associated I-shaped beam.

11. Screen plate according to claim 8, wherein the ledge means are drawn close to the support frame and laterally cover a portion of the I-shaped beam.

* * * * *